United States Patent [19]

Rayfield

[11] 4,002,337

[45] Jan. 11, 1977

[54] DEVICE FOR SUPPORTING A BALL CONTAINER FROM A TENNIS RACKET

[76] Inventor: Donald K. Rayfield, No. 9 Crestwood Drive, Oneonta, Ala. 35121

[22] Filed: Oct. 2, 1975

[21] Appl. No.: 618,744

[52] U.S. Cl. ..... 273/73 R; 206/315 B; 248/74 PB

[51] Int. Cl.[2] ..... A63B 61/00

[58] Field of Search ..... 273/26 B, 29 A, 72 R, 273/73 R, 73 C, 73 G, 74, 166, 189 R, 189 A, 54 B; 128/165; 248/74 PB; 24/17 A, 17 AP, 81 CC, 81 SK; 206/315 R, 315 B

[56] References Cited

UNITED STATES PATENTS

| | | | |
|---|---|---|---|
| 2,088,980 | 8/1937 | Stein | 273/74 X |
| 2,220,836 | 11/1940 | Closson | 128/165 X |
| 2,870,502 | 1/1959 | Sasse | 24/17 A |
| 2,890,790 | 6/1959 | Gibson | 206/315 B X |
| 2,932,514 | 4/1960 | Bergmark | 273/73 R |
| 3,238,939 | 3/1966 | Stubbs | 273/54 B X |
| 3,520,539 | 7/1970 | Haws | 273/166 |
| 3,804,084 | 4/1974 | Lehman | 128/165 X |

FOREIGN PATENTS OR APPLICATIONS

| | | | |
|---|---|---|---|
| 695,251 | 9/1964 | Canada | 248/74 PB |
| 1,237,836 | 6/1960 | France | 248/74 PB |

OTHER PUBLICATIONS

"World Tennis"; June 1975; p. 79.

*Primary Examiner*—Richard J. Apley
*Attorney, Agent, or Firm*—Woodford R. Thompson, Jr.

[57] ABSTRACT

A device for supporting a ball container from a tennis racket embodying an elongated flexible member having a first portion formed integrally with a second portion. The first portion is of a length to surround a tennis ball container with the end thereof adjacent the second portion overlapping the free end of the first portion and detachably connected thereto. The second portion defines an extension of the first portion and is of a length to extend around the handle of a tennis racket positioned alongside a ball container secured within said first portion with the free end of the second portion terminating alongside the outer surface of said first portion and detachably connected thereto.

1 Claim, 4 Drawing Figures

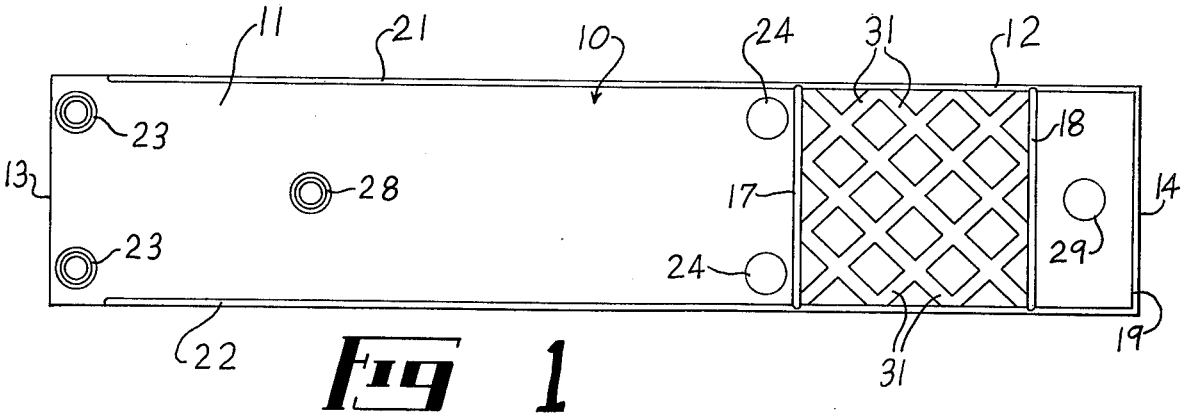
Fig 1
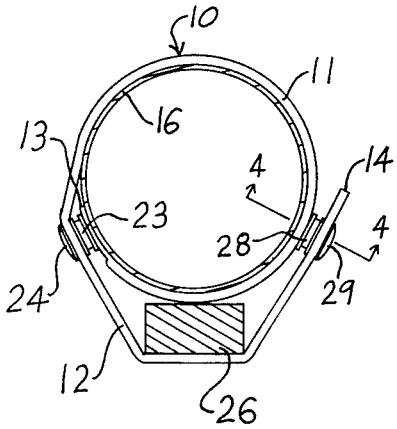
Fig 3
Fig 2
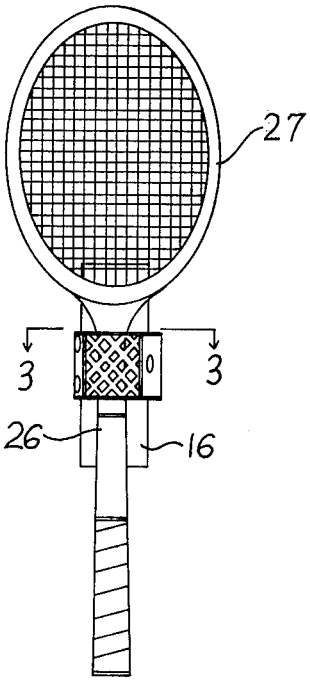
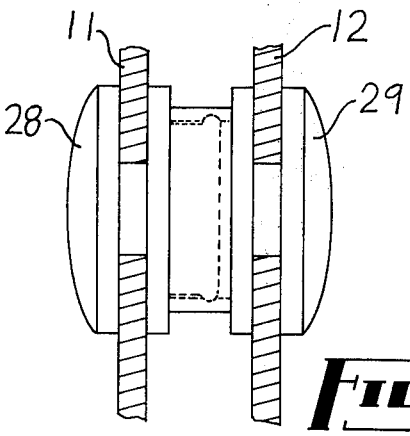
Fig 4

DEVICE FOR SUPPORTING A BALL CONTAINER FROM A TENNIS RACKET

BACKGROUND OF THE INVENTION

This invention relates to a device for supporting a ball container from a tennis racket and more particularly to such a device which may be detachably connected to the tennis ball container and detachably connected to the handle of a tennis racket whereby the tennis ball container is carried by the racket, thus eliminating the necessity of having to carry the ball container and the racket whereby the tennis ball container is carried by the racket, thus eliminating the necessity of having to carry the ball container and the racket separately.

As is well known in the art to which my invention relates, it is very difficult to keep up with the various items employed in playing tennis. If often occurs that the container carrying the tennis balls becomes misplaced or left behind whereby the player is unprepared to play upon reaching the tennis court.

SUMMARY OF THE INVENTION

In accordance with my invention, I provide a device for supporting a tennis ball container from a tennis racket wherein the ball container remains with the racket at all times while the racket is not used. This not only eliminates the necessity of having to hold two separate articles while going to and from the tennis court but also assures that the tennis balls are not misplaced or left behind. The device comprises an elongated flexible member having a first portion formed integrally with a second portion. The first portion is of a length to surround a tennis ball container with one end of the first portion overlapping the free end of the first portion and detachably connected thereto. The second portion is an extension of the first portion and is of a length to extend around the handle of a tennis racket extending alongside a ball container secured within the first portion with the free end of the second portion terminating alongside the outer surface of the first portion and detachably connected thereto.

DESCRIPTION OF THE DRAWING

A device embodying features of my invention is illustrated in the accompanying drawing, forming a part of this application, in which:

FIG. 1 is a plan view showing the outer side of the device while in the inoperative position;

FIG. 2 is a side elevational view, drawn to a smaller scale, showing the device in use;

FIG. 3 is an enlarged, sectional view taken generally along the line 3—3 of FIG. 2; and, FIG. 4 is an enlarged, sectional view taken generally along the line 4—4 of FIG. 2 with the tennis ball container being omitted, for the sake of clarity.

DETAILED DESCRIPTION

Referring now to the drawing for a better understanding of my invention, I show an elongated, wide flexible member 10 having a first portion 11 formed integrally with a second portion 12 with the first portion 11 having a free end 13 and the second portion 12 having a free end 14. The first portion 11 is of a length to surround a cylindrical tennis ball container 16 with the end of the first portion 11 which is connected to the second portion 12 overlapping the free end 13 of the first portion 11, as shown in FIG. 3. A transverse reinforcing rib 17 may be carried by the elongated member 10 adjacent the point of juncture between the first portion 11 and the second portion 12, as shown in FIG. 1. Also, additional transverse ribs 18 and 19 may be carried by the second portion 12, as shown. In like manner, longitudinally extending ribs 21 and 22 may be provided along the longitudinal edges of the elongated member 10.

As shown in FIGS. 1 and 3, female fastener elements 23 are carried by the first portion 11 of the elongated member 10 adjacent the free end 13 in position to cooperate with male fastener elements 24 carried by the other end of the first portion 11. Accordingly, the cooperating fastener elements 23 and 24 detachably connect the free end 13 of the first portion 11 to the other end thereof, as shown in FIG. 3, whereby the tennis ball container 16 is secured firmly within the first portion 11.

As shown in FIGS. 1 and 3, the second portion 12 defines an extension of the adjacent end of the first portion 11 and is of a length to extend around the elongated handle 26 of a tennis racket 27 with the handle 26 extending alongside the tennis ball container 16 secured within the first portion 11. The free end 14 of the second portion 12 terminates alongside the outer surface of the first portion 11 and is detachably connected thereto by cooperating fastener elements 28 and 29 carried by the first portion 11 and the second portion 12, respectively. As shown in FIG. 4, the cooperating fastener elements 28 and 29, as well as the cooperating fastener elements 23 and 24, are conventional type snap fasteners having male and female elements which are detachably connected to each other.

As shown in FIG. 1, portions of the material from which the second portion 12 is formed may be omitted to provide spaced apart connecting members, such as diagonal members 31 which cross each other. By providing the diagonal members 31 in the portion 12 of the elongated member 10, this portion is more flexible whereby it may be readily bent around the handle 26 of the tennis racket 27, as shown in FIGS. 2 and 3, to thus facilitate assembly of the device on the tennis racket.

From the foregoing description, the operation of my improved device for supporting a ball container from a tennis racket will be readily understood. The first portion 11 of the elongated member 10 is wrapped around the ball container 16, as shown in FIG. 3, whereby the fastener elements 23 and 24 are in position to engage each other and thus secure opposite ends of the first portion 11 to each other in overlapping relationship. With the first portion 11 thus secured firmly to the tennis ball container 16, the handle 26 of the tennis racket 27 is positioned alongside the ball container 16, while the ball container is encased within the first portion 11, as shown in FIGS. 2 and 3. The portion 12 is then wrapped around the handle 26, as shown in FIG. 3, whereby the fastener elements 28 and 29 are then in position to engage each other and thus secure the handle 26 firmly between the inner surface of the portion 12 and the outer surface of the portion 11 of the elongated member 10.

From the foregoing, it will be seen that I have devised an improved device for supporting a tennis ball container from a tennis racket. By providing a flexible device which may be readily snapped onto the tennis ball container, together with the flexible extension which then moves around the handle of the tennis racket and secures the handle in place, the tennis ball container may be conveniently carried by the tennis racket whereby there is no danger of the ball container being misplaced. Preferably, the ball container is positioned in spaced relation to the grip portion of the handle engaged by the hand of a user, whereby the tennis racket may be carried by the handle in the usual manner. Also, by forming the elongated member 10 of a flexible material and detachably connecting the portions thereof to each other by fastener elements, the device is extremely simple of construction and economical of manufacture. Furthermore, this construction permits the device to be attached to the ball container and to the handle of the tennis racket with a minimum of effort.

While I have shown the fastener elements 23, 24, 28 and 29 as being snap-type fasteners, it will be apparent that many other types of fastener elements may be employed, such as conventional hook and eyelet type fasteners, button type fasteners and cooperating fabric type fastener elements with one element having a felt-like surface and the other element having a plurality of small hook-like members disposed to engage the felt-like surface. Such fastener elements are disclosed in U.S. Pat. No. 2,717,437.

While I have shown my invention in but one form, it will be obvious to those skilled in the art that it is not so limited, but is susceptible of various changes and modifications without departing from the spirit thereof.

What I claim is:

1. The combination with a cylindrical tennis ball container and an elongated handle of a tennis racket:

a. an elongated, wide flexible member having a first portion formed integrally with a second portion with said first portion having a free end and said second portion having a free end, b. said first portion being of a length to surround said tennis ball container with one end of said first portion overlapping said free end of said first portion, c. means detachably connecting said one end of said first portion to said free end of said first portion with said tennis ball container secured within said first portion, d. said second portion defining an extension of said one end of said first portion and being of a length to extend around said handle of a tennis racket positioned alongside said tennis ball container secured within said first portion with the free end of said second portion terminating at a location alongside the outer surface of said first portion to provide sufficient length in said second portion to surround said handle of a tennis racket, and e. means detachably connecting the free end of said second portion to said first portion at said location with said handle of a tennis racket secured in place between said second portion and said first portion.

* * * * *